US005077843A

United States Patent [19]

Foster L. Dale et al.

[11] Patent Number: 5,077,843

[45] Date of Patent: Jan. 7, 1992

[54] HOSPITAL BED AND ASSEMBLIES OF HOSPITAL CARE APPARATUS

[75] Inventors: Foster L. Dale, Brookville; Michael E. Poehner, West Harrison, both of Ind.

[73] Assignee: Hill-Rom Company, Inc., Batesville, Ind.

[21] Appl. No.: 576,837

[22] Filed: Sep. 4, 1990

Related U.S. Application Data

[63] Continuation-in-part of Ser. No. 386,210, Jul. 28, 1990.

[51] Int. Cl.[5] ..... A47G 7/00

[52] U.S. Cl. ..... 5/60; 5/185; 5/503; 5/508; 5/449

[58] Field of Search ..... 5/181, 185, 60, 508, 5/, 503, 818, 449, 455; 52/39, 29, 32, 36; 248/122, 282, 283, 124, 125

[56] References Cited

U.S. PATENT DOCUMENTS

| | | | |
|---|---|---|---|
| 1,576,211 | 3/1929 | O'Kane | 5/455 |
| 2,729,314 | 1/1956 | Doran | 52/36 |
| 3,327,328 | 6/1967 | Slivoski | 5/181 |
| 3,585,660 | 6/1971 | Gottfried | 5/60 |
| 3,921,345 | 11/1975 | Damico | 52/36 |
| 4,669,136 | 6/1987 | Waters | 5/181 |
| 4,795,122 | 1/1989 | Petre | 5/503 |
| 4,811,435 | 3/1989 | Foster | 5/60 |
| 4,856,741 | 8/1989 | Schaefer | 5/508 |

FOREIGN PATENT DOCUMENTS

| | | | |
|---|---|---|---|
| 411157 | 6/1934 | United Kingdom | 5/449 |

*Primary Examiner*—Gary L. Smith
*Assistant Examiner*—F. Suether
*Attorney, Agent, or Firm*—Wood, Herron & Evans

[57] ABSTRACT

A hospital bed has, at least at its head end, longitudinally extending inflatable mattress sections on each side of the bed. When those mattress sections are deflated, that portion of the bed can be narrowed to permit a nurse to move into the vacated space along side the bed and to permit hospital equipment such as an IV rack to be moved into the vacated spaced on the other side of the bed. Thus, the nurse can conveniently reach the patient as well as the patient care instruments on the opposite side of the bed.

14 Claims, 7 Drawing Sheets

HOSPITAL BED AND ASSEMBLIES OF HOSPITAL CARE APPARATUS

This is a continuation-in-part of U.S. application Ser. No. 07/386,210, filed Jul. 28, 1990.

This invention relates to a hospital bed and, more particularly, to a hospital bed that is designed to reduce the time and labor required to attend a patient, especially a patient requiring critical care.

BACKGROUND OF THE INVENTION

Critical care rooms are designed to provide patients with many services such as oxygen, vacuum, vital signs monitors, intravenous administration, electrical services and communication services. Most important of all, the critical care rooms will have the services of nurses to correctly apply the available patient care instruments as needed. The nurse will also perform the normal charting activities.

Current studies demonstrate that even with the most efficient equipment, the nurse is required to take many steps in the patient's room to perform the necessary services. The nurse must physically reach, touch and manipulate the patient, the administration sets, the monitor equipment, and the charting equipment.

The most efficiently appointed critical care room today has a power column and a swinging IV rack. The power column brings gas, electric and monitoring facilities to the patient. The power column also has shelves and racks for patient care accessories. The Hill-Rom, Inc. power column concentrates all of these instrumentalities in a tall, narrow, floor-to-ceiling column that stands away from the room wall. The hospital bed is positioned with respect to the power column so that the power column is at the corner of the bed. This provides patient access on all four sides of the bed.

The swingable IV rack (U.S. Pat. No. 4,795,122) has some limited capability of positioning. It is designed to be swung to a position for mounting on the bed so that the bed could be moved with the rack, or, alternatively, swung out of the way of the bed.

Ideally, with current equipment, the power column is located at one corner of the bed, and the IV rack is located at the other corner at the head end of the bed. A computer charting facility is located on a desk or on a stand in the patient's room. Even with these efficient tools the nurse must walk from side to side to reach both sides of a patient and to reach the patient care instrumentalities at each side of the bed and to reach the patient charting computer.

Co-pending U.S. application Ser. No. 07/309,886 discloses a pivoting power column that is capable of being swung to either side of the bed, a pivoting IV rack that is capable of being swung to either side of the bed, and a computer terminal preferably located at the foot end of the bed, but is capable of being swung to either side of the bed. The disclosure of that copending application is hereby incorporated by reference to form a part of the present disclosure. All of these features have been designed to bring the patient care equipment to the patient in a position that enables the nurse to function most efficiently while standing in one place alongside the bed. But still, there is need to walk to the other side of the bed to reach the patient and to reach the instruments positioned on the other side of the bed.

SUMMARY OF THE PRESENT INVENTION

It has been an objective of the present invention to minimize the steps that a nurse is required to take to perform all of the required services in a critical care room.

This objective of the present invention is attained through the realization that the hospital bed is so wide that the nurse cannot conveniently reach both sides of the patient and cannot reach equipment located on the opposite side of the bed from which the nurse stands. The hospital bed has a patient support surface mounted on a base, the patient support surface including a mattress that is usually between thirty-four and thirty-six inches wide. Side guards are added so that the bed is about forty-three inches wide. It is, of course, known to provide retractable side guards but nevertheless the bed is about thirty-six inches wide. A five-foot-two nurse can reach across only about twenty-five to thirty inches of a thirty-six inch bed. Thus, the nurse cannot reach equipment that is located on the opposite side of the bed from the nurse and cannot conveniently reach the extremities of the patient to which administration equipment is connected.

In accordance with the present invention the problem of reach is solved by providing collapsible side sections on each side of the bed. These collapsible side sections vacate a space about five inches wide, thus narrowing the bed by about five inches on each side. This permits the nurse to move closer on one side and to bring equipment closer on the other side, thereby shortening the reach problem by about ten inches.

In the preferred embodiment of the invention, it is possible to swing the power column to one corner or the other of the bed. The IV rack can be moved immediately above the space vacated by the collapsed mattress section. (It is not permissible for hospital equipment such as an IV rack to overlie any part of the bed because of the destructive effect of the inadvertent raising of the bed with a structure immediately overhead. Even though an IV rack is swung above the bed, it must be positioned outside the confines of the bed for the reasons indicated.)

Thus, with the side sections collapsed and the equipment in place the nurse can stand in the area vacated by a side section adjacent the power column and take care of the patient while manipulating the power column and observing the monitor on the power column. To the extent that the IV rack must be reached, it, being positioned in a space vacated by the side section on the other side of the bed, is easily reachable by the nurse.

In copending U.S. application Ser. No. 07/386,210, a bed is disclosed having wings that are pivotable upward to fold up mattress side sections and to narrow a bed. The disclosure of that copending application is fully incorporated herein by reference. The present invention extends the usefulness of that concept and improves upon the structure for carrying out the concept.

Further in accordance with the present invention, the collapsible side sections consist of inflatable mattress sections mounted on wings that can swing from a horizontal to a vertical position. They are connected to a compressor for quick inflation. Preferably, a pneumatic piston and cylinder are provided for operating both wings upon the touch of a switch by the nurse. Thus, when the nurse comes into the patient's room, a touch of the button or downward shift of the head guards will effect the narrowing of the head end of the bed by about five inches on each side. The nurse can move into the vacated space and begin the care of the patient. All of the necessary instruments can be conveniently reached by the nurse so that no steps are required for the completion of the care of the patient.

The several features and objectives of the present invention will become more readily apparent from the following detailed description taken in conjunction with the accompanying drawings in which:

DETAILED DESCRIPTION OF THE DRAWINGS

Figure 1:
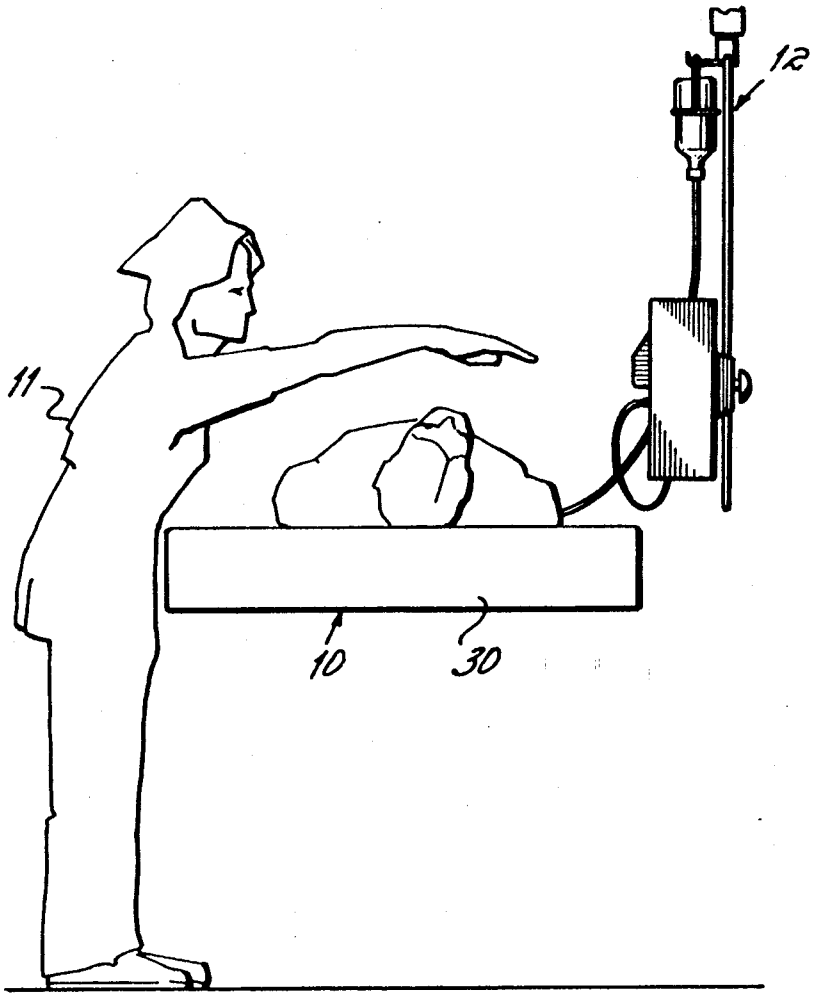
PRIOR ART FIG. 1
FIG. 1 is a diagrammatic and elevational view of a prior art bed.

Referring to FIG. 1, there is illustrated the end of a hospital bed 10 that is about thirty-five inches wide. The illustration shows a five-foot-two inch nurse alongside a bed 10. FIG. 1 shows the limited extent of the reach of the nurse 11. An IV rack 12 is shown at about forty inches from the center of gravity of the nurse, and that is significantly beyond the reach of the nurse 11. The nurse 11 therefore must walk around the bed 10 in order to deal with the patient care instruments supported on the IV rack 12. (In this description the term "IV rack" is used to embrace a support for patient care instruments of any type, but usually those that are invasively connected to the patient).

Figure 2:
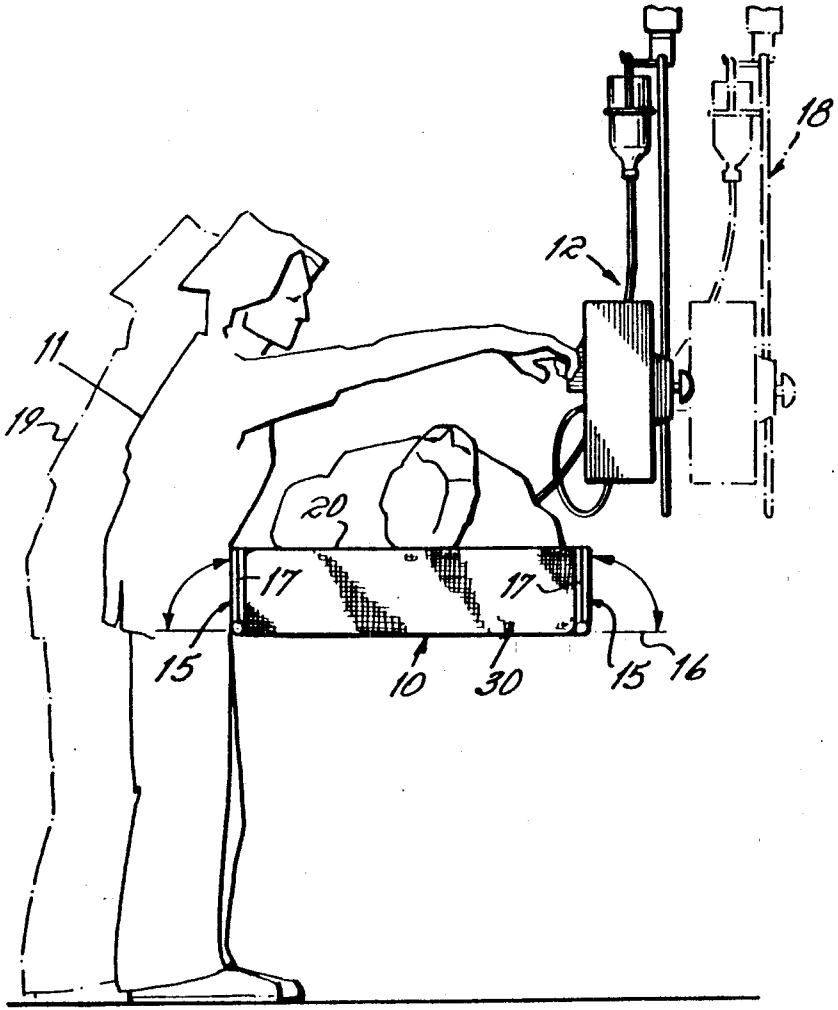
FIG. 2 is a view similar to FIG. 1 of a bed in accordance with the present invention.

The invention is illustrated in FIG. 2. The bed 10 has side sections 15 which are about five inches in width as indicated at 16 in FIG. 2. Those side sections 15 are collapsible to the positions indicated at 17 wherein the thirty-five inch bed is contracted to a surface that is twenty-five inches wide.

On the right side of FIG. 2 there is shown the IV rack 12 moved from the phantom line position 18 to the full line position so that it overlies the space vacated by the collapsed side section 15.

A nurse, similarly, has moved from the phantom line position 19 to the full line position shown in FIG. 2 which is five inches closer to the patient. The distance from the nurse 11 to the IV rack 12 is reduced by ten inches thus bringing the IV rack 12 as well as the remote side of the patient well within the reach of the nurse 11.

All of this is accomplished by the collapsible side sections 15, particularly at the head end of the bed 10.

Figure 3:
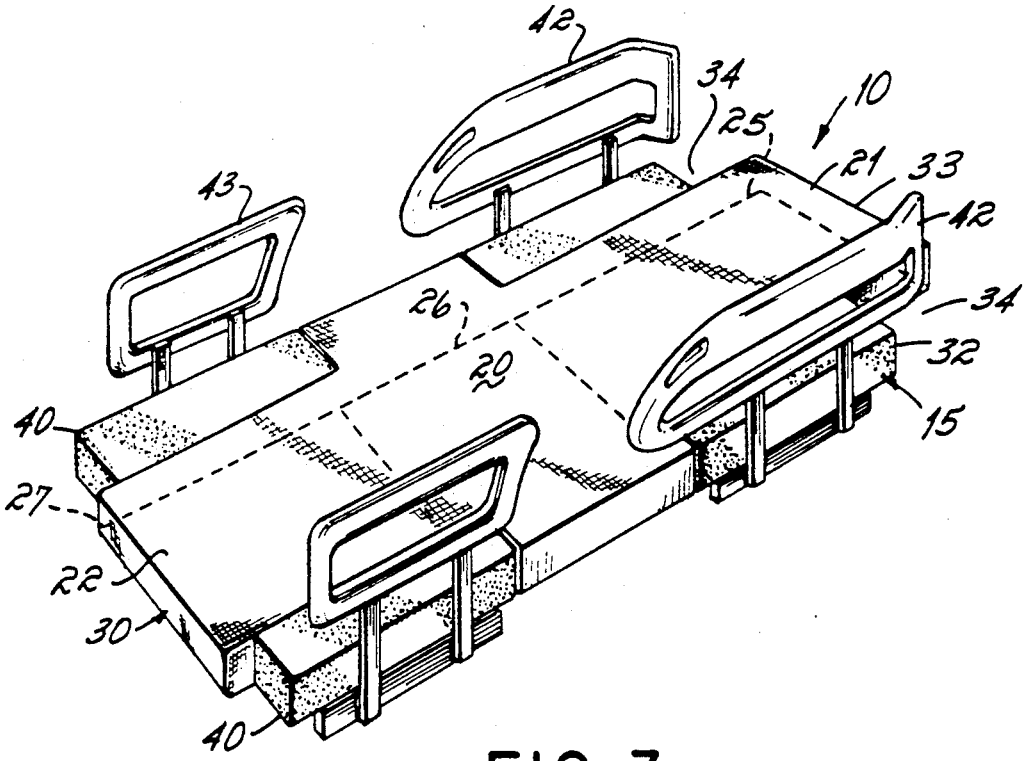
FIG. 3 is a diagrammatic perspective view of a patient support in accordance with the present invention.

A bed 10 of the type to which the present invention is directed has a support surface 20 as shown in the perspective view of the FIG. 3. The support surface has a head end 21 and a foot end 22. The bed 10 preferably has its support surface broken into three or four articulating panels including a head panel 25, a seat panel 26, and a leg panel 27. These panels are covered by a mattress 30. The panels and mattress have, at the head end, collapsible side sections 15. The side sections preferably do not extend all the way to the end of the bed but terminate at ends 32 short of the head end 33 of the bed 10, thereby creating notches 34. The removal of obstruction by forming the notches 34 introduces the capability of swinging a power column or computer, to be described, in a tighter arc, thus keeping it closer to the bed 10 and patient. At the foot end 22 of the bed, similar collapsible side sections 40 are provided.

At the head end 21 of the bed 10, the bed is provided with head guards 42 and at the foot end 22 of the bed, the bed is provided with foot guards 43. The support structure and manipulation of the guards is shown in detail in copending application Ser. No. 07/386,210. That structure permits head guards 42 to be swung from the position depicted in FIG. 3 to the position depicted in FIG. 4. When the head guard is moved out of the way, the side sections 15 can be collapsed to reduce the width dimension of the bed at the head end of the patient where the manipulation of the patient care instruments principally takes place. The foot guards 43 can be moved down and under the bed so that the foot end 22 of the bed can be narrowed also. This is useful primarily in narrowing the bed for transporting a patient from his room to another part of the hospital such as the X-ray room or the like. That has been disclosed in copending application Ser. No. 07/386,210.

Figure 4:
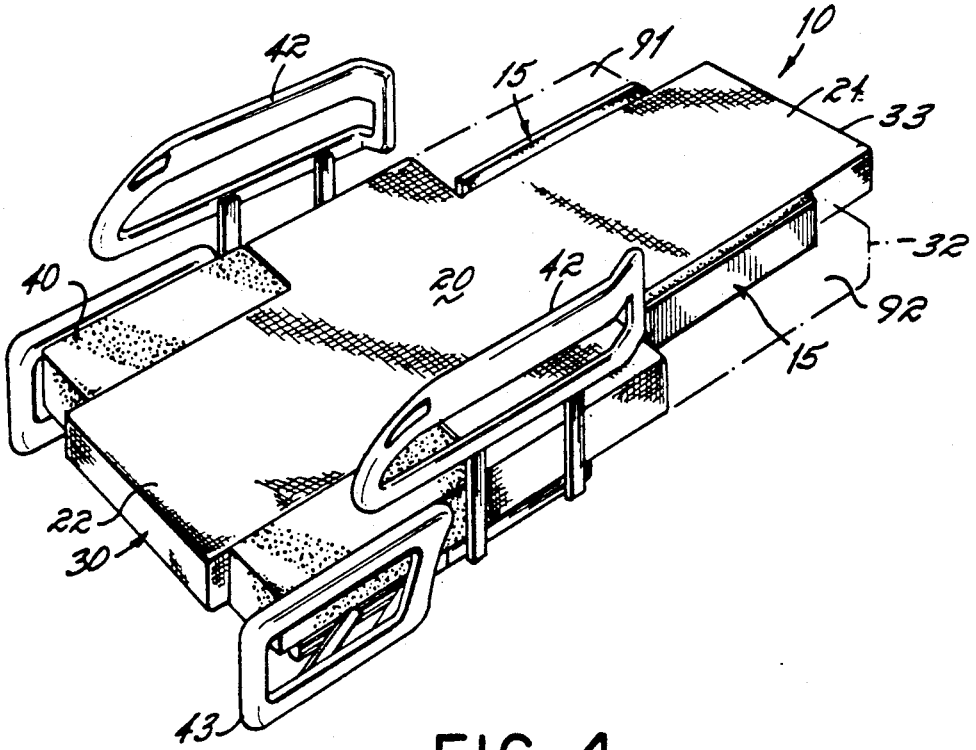
FIG. 4 is a view similar to FIG. 3 illustrating the narrowing of the head end of the bed.
Figure 5:
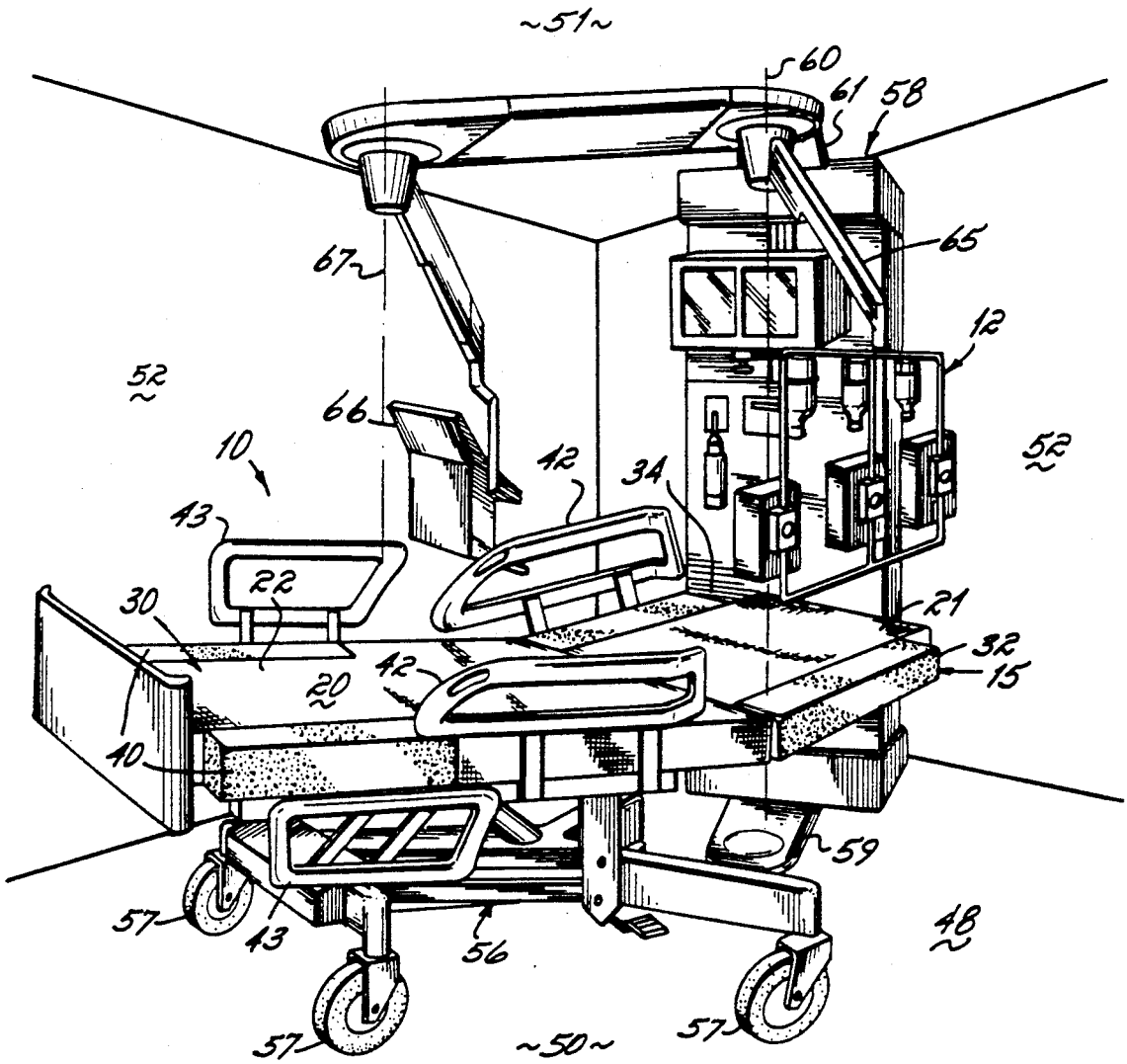
FIG. 5 is a perspective view of a hospital room containing the bed and some patient care instruments.

FIG. 5 illustrates a hospital room wherein the present invention is employed. The hospital room 48 has a floor 50, a ceiling 51, and walls 52. Mounted on the floor is the bed 10. The bed 10 has a base 56 having castored wheels 57 that engage the floor of the room. The bed 10 has the support surface 20 discussed in connection with FIGS. 3 and 4.

The hospital room also contains a pivoted power column 58 of the type disclosed in copending application Ser. No. 07/309,886. The pivoted power column 58 has an arm 59 that is mounted on the floor 50 to pivot on an axis 60 through the head end 21 of the bed 10. A ceiling mounted arm 61 supports that upper end of the power column, but the major load of the power column is taken up by the lower arm 59 in the preferred form of the invention.

Figure 8:
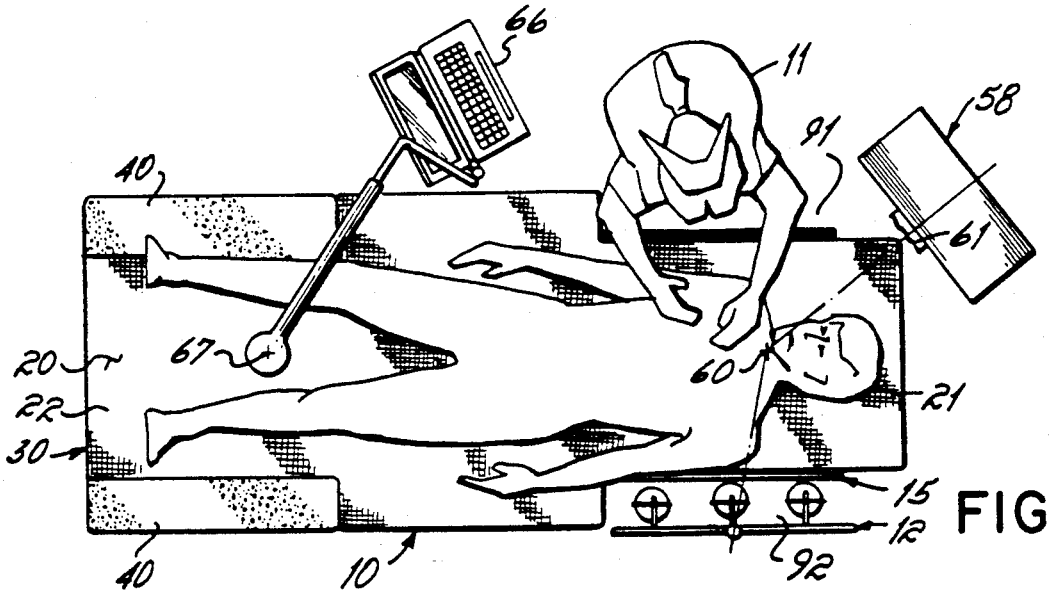
FIG. 8 is a plan view similar to FIG. 5 showing the nurse easily reaching the patient care instruments.

The IV rack 12 is mounted on a pivot arm 65 that is on the same axis 60 as the pivoted power column 58. The IV rack 12 is adapted to be swung into a space vacated by one of the side sections 31 at the head end 21 of the bed 10, as best shown in FIG. 8.

Finally, in the hospital room there is a computer terminal 66 that is pivoted on an axis 67 passing through the foot end 22 of the bed 10 enabling the computer terminals 66 to be swung to either side of the bed for easy access of the nurse 11 standing alongside the bed.

Figure 6:
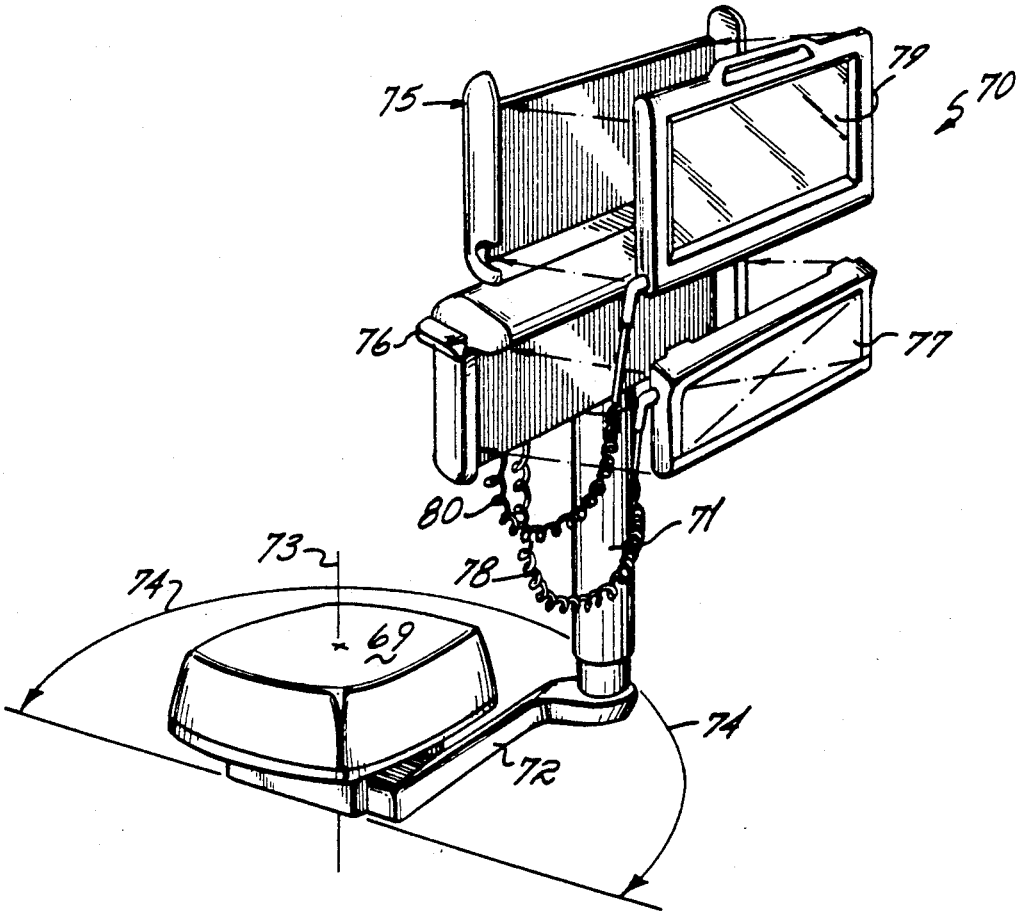
FIG. 6 is a perspective view showing an alternative form of a computer.
Figure 7:
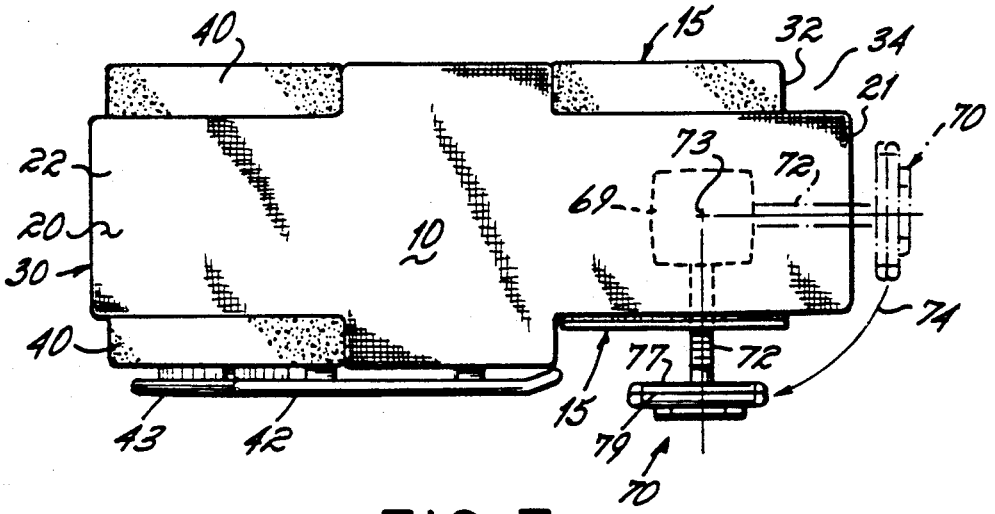
FIG. 7 is a plan view of the computer of FIG. 6 showing that it can be pivoted to either side of the bed.

An alternative form of the computer aspect of the invention is illustrated in FIGS. 6 and 7. This embodiment is for a med-surge room for patients of lower acuity where no power column is required. A computer 70 is mounted on a gas spring-assisted vertical column 71 by which the computer 70 can be raised and lowered. The column 71 is mounted on an arm 72 and pivoted at a CPU housing 69 having an axis 73 passing through the head end 21 of the bed 10. The arm 72 permits the column to swing in an arc depicted by the arrow 74.

The column 71 carries a housing 75 to which is mounted an actuator lever 76 for raising and lowering the housing on the vertical column 71. The housing carries a keyboard 77 which is preferably tethered to the housing by a coil cord 78, and a touch screen display 79 which is tethered to the housing by a coil cord 80.

The elements heretofore described constitute a work center that can be pivoted to either side of the bed 10. As thus shown in FIG. 7, the work center can be swung to a position alongside the bed. The removable mattress sections permit the touch screen 79 display to be moved close enough to the patient to enable the patient to touch the screen and thus interact with the computer. The tethered keyboard 77 and tethered touch screen display enhances the versatility of the unit.

As best shown in the plan view of FIG. 8, the collapsible wings 35 of the bed, together with the patient care equipment as described, combine to enhance the efficiency of the nurse 11 in a very significant way. The nurse stands in an area 91 vacated by the collapsed side section 15. The power column 58 is positioned at the corner at the head end of the bed within the reach of the nurse 11. The IV rack 12 is positioned in the area 92 vacated by the other collapsed side section 15. The computer 66 is swung to a position immediately available to the nurse on the nurse's right side. All of the instruments are within easy reach of the nurse who can stand in the position indicated without moving to any other section of the bed. It should be understood that all positions can be reversed to the other side of the bed in view of the movability of the power column 58, the IV rack 12 and the computer 66 so that the nurse 11 can administer to the patient from the other side of the bed with all of the patient care instruments within easy reach.

Figure 9:
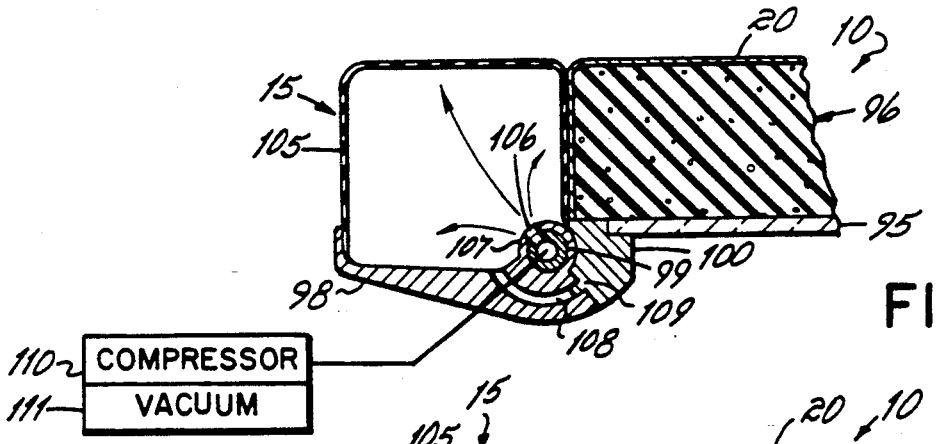
FIGS. 9, 10 and 11 are diagrammatic representations of the mechanism by which the side sections are inflated and deflated.
Figure 10:
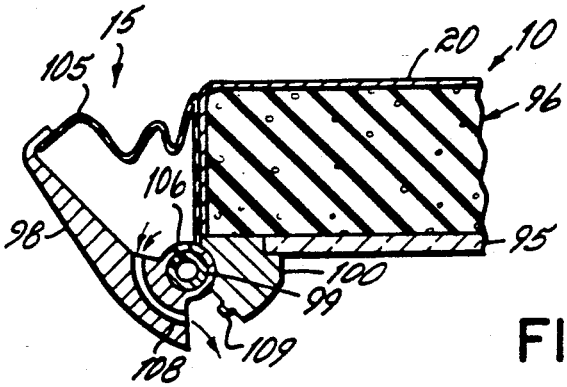
Figure 11:
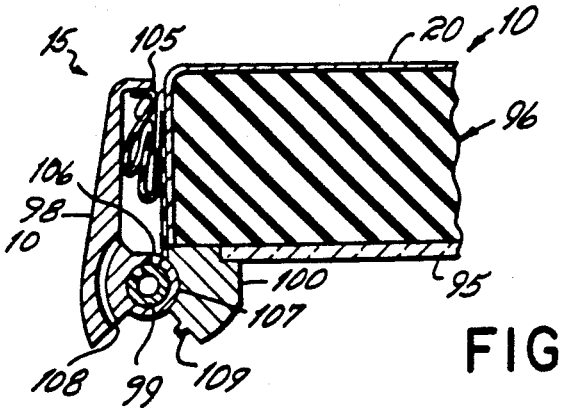

A mechanism by which the side section 15 can be inflated and deflated is illustrated in FIGS. 9, 10 and 11.

The body support 20 has a rigid panel 95 which, at least at the head end of the bed, is preferably X-ray translucent so that a C-arm X-ray unit can be employed with the bed of the present invention. A thick, comfortable mattress 96 is mounted on top of the panel 95. To the extent that the bed is divided into plural body support sections, such as the head, seat, thigh and leg sections, the panels and mattresses may be segmented.

An elongated wing 98 is pivotally mounted on a manifold tube 99 secured by a bracket 100 to the panel 95. The wing 98 carries a bladder 105. The bladder is connected to plural inlet ports 106 spaced longitudinally along the generally circular cross-section hinge 107. A plurality of outlet ports 108 are spaced longitudinally along the wing 98 adjacent its hinge. Each outlet port 108 is aligned with a cooperating plug 109 that is mounted on the bracket 100, the plug 109 entering the outlet port 108 to seal it closed when the wing 98 is in the horizontal attitude depicted in FIG. 9.

The manifold tube 99 is connected to a compressor system 110 and optionally a vacuum pump 111. The compressor system 110 is adapted to pump air into the bladder 105 by pumping air through the manifold 99. The air in the manifold 99 passes through the aligned ports in the manifold and circular hinge section 107, respectively, to fill the bladder rapidly.

When the spaces 91, 92 (FIG. 8) are to be vacated, the wings are swung upwardly as depicted in FIGS. 10 and 11. As the upward swinging begins, the plug 109 in each port exposes each port to atmosphere permitting the compressed air in the bladder to exhaust through the multiple ports. It may be desired to have a vacuum applied by means of a vacuum pump operating through the manifold 99 as a preliminary to the upward swinging of the wing 98.

In a preferred form of the invention, it is contemplated that when the head guard 42 is swung to the foot end of the bed as illustrated in FIGS. 3 and 4, a switch (not shown) will be triggered that automatically effects the upward swinging of the wings 98 on both sides of the bed. Such a switch can be disabled by the nurse so that the head guard can be moved without collapsing the side sections.

Figure 12:
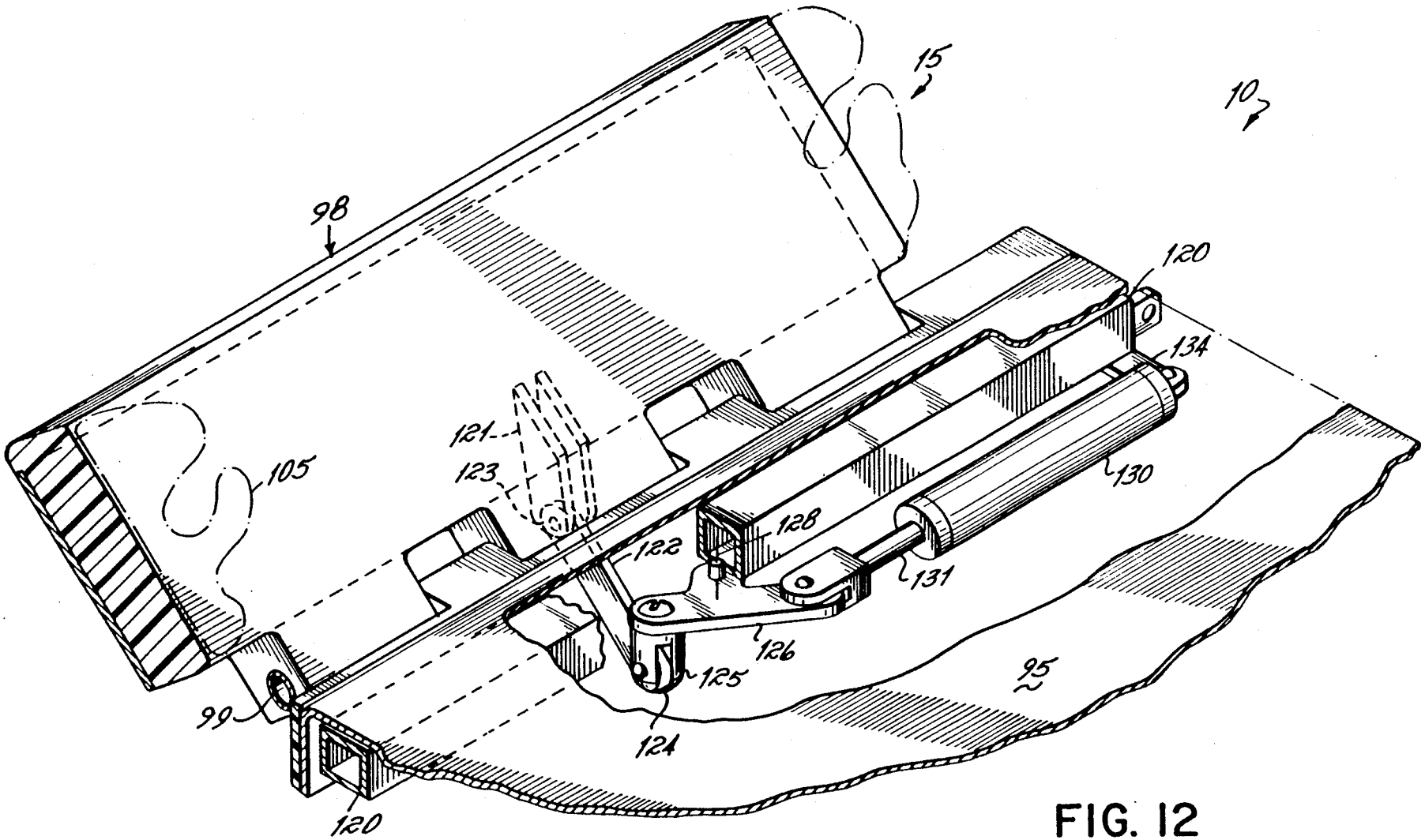
FIG. 12 is a perspective view partially broken away of a head panel showing a side section partially collapsed.

One form of mechanism for swinging the wings is illustrated in FIG. 12. As shown in FIG. 12, each panel has an aluminum tubular frame 120. The translucent panel 95 is secured to the frame. The wing 98 is hinged to the panel 95.

The wing 98 carries a pair of bracket arms 121. A lift arm link 122 is pivoted at one end 123 to the bracket 121. The other end 124 of the lift arm link is pivoted to a lower knuckle 125 which is pivoted to a pivot plate assembly 126. The pivot plate 126 assembly has a centrally located pivot axis 128 which is connected to the aluminum frame 120. A double-acting, hydraulic cylinder 130 has a rod 131 pivotally mounted to the other end of the pivot plate assembly 126. The hydraulic cylinder 130 is pivoted to the aluminum frame member at 134. When the hydraulic cylinder is operated to extend the rod 131, it swings the pivot plate 126 assembly which, through the knuckle 125 and lift arms 122, thrusts the wing 98 from a horizontal attitude to a vertical attitude as depicted in FIG. 12.

In the operation of the invention, the nurse enters the critical care room 48 and swings the head guards 43 horizontally toward the foot end of the bed as depicted in FIG. 4. The swinging of the head guard automatically trips the switch, causing the hydraulic cylinder to urge the respective wing from a horizontal position to a vertical position to vacate one of the respective spaces 91, 92. The air in the bladder 105 (shown in phantom in FIG. 12) is rapidly exhausted to permit the collapse of the side edge section 15. The nurse then moves to one of the vacated positions 91 and 92. The power column 58 will have been previously located at the corner where the nurse is to stand, that position having been selected as being the best for the administration of care to the patient. The IV rack is positioned over the space 92 and the computer terminal 66 brought into position alongside the nurse as shown in FIG. 8.

Without undue walking around the bed and the patient, the nurse provides all of the care required for the patient and does all of the charting on the computer that is immediately at hand.

Figure 13:
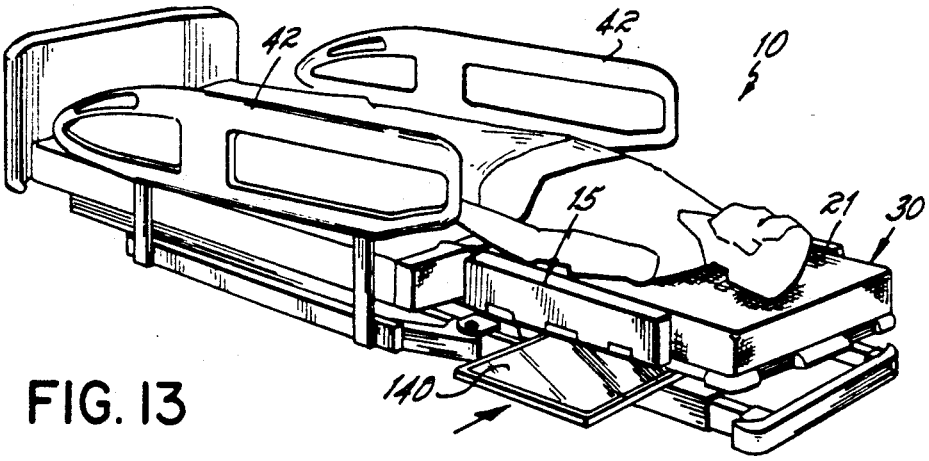
FIG. 13 is perspective view of the bed when loading an X-ray film.

The collapsible side edges 15 have additional advantageous applications. As shown in FIG. 13, when the head guard 43 is shifted downwardly and the side edge 15 is collapsed, an open access is created for the direct loading/positioning of X-ray film 140.

Figure 14:
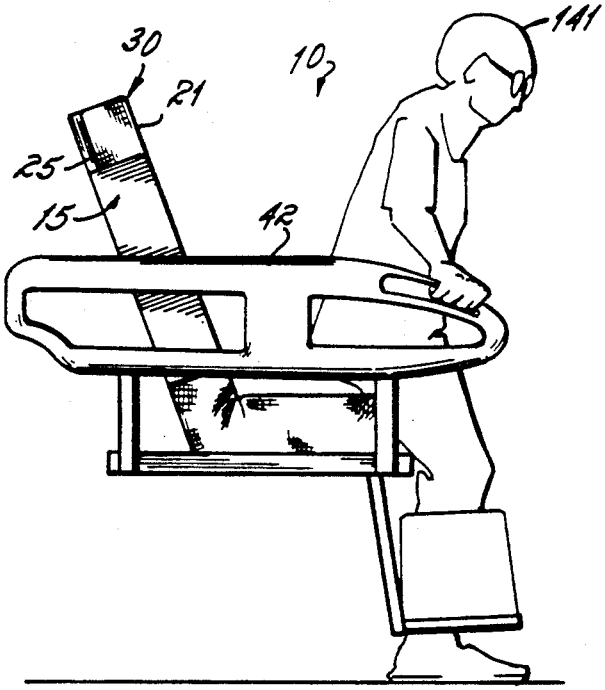
FIG. 14 is a side view of the bed when converted into a chair.
Figure 15:
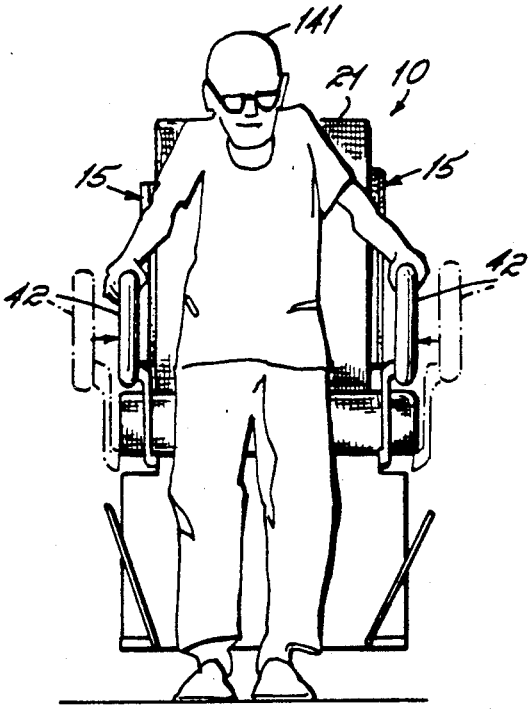
FIG. 15 is a front view of FIG. 14 showing the head guards shifted towards the patient for a better grasp.

The collapsible side edges improve the hospital bed convertible to a chair U.S. Pat. No. 4,862,529. When in the chair orientation, the head panel 25 is upwardly-inclined, as shown in FIG. 14. The side edges 15 have been collapsed. The head guards 43, shifted toward the foot end, are shifted to their inward position as disclosed in copending application Ser. No. 07/386,210 (see FIG. 15) so as to reduce the extent to which the patient, indicated at 141, must reach to grasp the arms. In that tucked-in condition, the patient can more easily and safely shift himself to and from the bed that has been converted into a chair.

Figure 16:
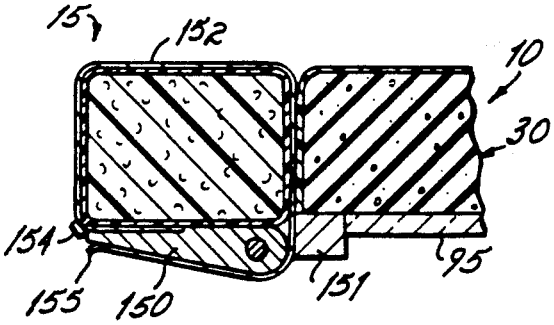
FIGS. 16 and 17 are cross-sectional views of a third embodiment of the invention.
Figure 17:
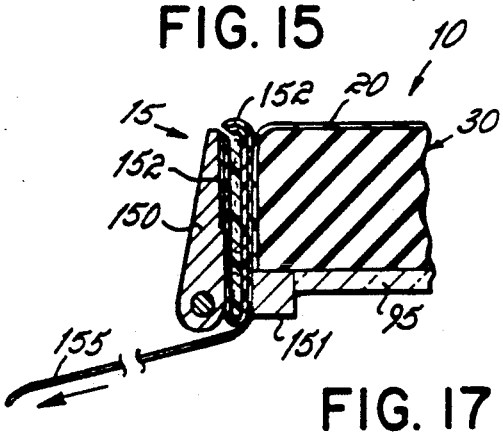

An alternative form of the invention is shown in FIGS. 16 and 17. An elongated wing 150 is pivotally mounted on a bracket 151 fixed to the translucent panel 95. The wing 150 carries a bladder 152 of rectangular cross section, the bladder having a valve 154 which can be opened or closed. The bladder 152 contains an open-cell foam 153. A pull strap 155 is wrapped around the bladder 152 in such a direction that pulling on it will force the wing 150 to pivot upwardly and collapse the foam within the bladder. When the space is to be vacated, the nurse opens the valve 154 and pulls the pull strap 155 which compresses the foam and exhausts the air from the bladder 152. The wing swings to its upper position shown in FIG. 17. Valve 154 is then closed to prevent air from reentering the bladder and thus the bladder and wing are retained in the attitude depicted in FIG. 17.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A hospital bed comprising,
a base,
patient support panels mounted on said base, said panels including a head panel for supporting the upper part of a patient's body, said head panel having longitudinal wings
a mattress, covering said panels,
said mattress being formed in part by inflatable side sections overlying said wings, which, when deflated, narrow a patient's support area thereby permitting a nurse to stand closer to a patient on one side of said bed and to bring patient care equipment closer to the patient and nurse on the other side of said bed.

2. A hospital bed as in claim 1 in which said wings having means for collapsing said side sections when said side sections deflate as said wings are swung upwardly.

3. A bed as in claim 2,
said wings each having a manifold extending along its length,
said manifold having a plurality of port connected to the interior of a bladder,
a source of compressed air,
means for connecting said compressed air source to said manifold when the wing is in a horizontal position thereby to inflate said bladder.

4. A bed as in claim 3 further comprising power means for swinging said wings between horizontal and vertical positions.

5. A hospital bed as in claim 1 in which said mattress side sections comprise,
said elongated wings hinged to said panel to swing between horizontal and vertical positions,
said wings having a plurality of ports along their length,
means for closing said ports when said wings are in a horizontal position and for opening said ports when said wings moves toward a vertical position to deflate said bladder,
a bladder attached to each wing and having an interior connected to said ports,
a source of compressed air,
means for directing compressed air to said bladder when said ports are closed.

6. A hospital bed as in claim 5 further comprising, a vacuum pump,
means for connecting said vacuum pump to said bladder when said port are open.

7. A bed as in claim 5 further comprising power means for swinging said wings between horizontal and vertical positions.

8. A bed as in claim 1,
said inflatable side sections being formed by an open cell foam enclosed by an airtight skin,
valves means for opening said skin to atmospheric pressure to inflate and deflate said foam interior,
and to selectively close said skin when said cells are inflated.

9. A hospital bed as in claim 1,
said head panel having an end,
said inflatable side sections having ends, said section ends terminating short of said panel end to create unobstructed notches at head end corners of said bed thereby permitting patient care apparatus to swing in an arc that keeps the apparatus as close as possible to the patient.

10. A hospital bed as in claim 9 in a hospital room having a floor further comprising,
a power column,
an arm pivotally mounted on said floor on a vertical axis passing through said head panel,
said power column being mounted on said arm for movement in an arc passing around the head end of said bed and through said unobstructed notches.

11. A hospital bed as in claim 1 further comprising,
a power column disposed at one corner at the head end of said bed,
an IV rack, means for disposing said IV rack in a position overlying the area, at the other head end corner, vacated by the deflated mattress side section,
whereby a nurse, standing in the area vacated by said deflated side section adjacent said power column, can reach across a patient in said bed and manipulate equipment on said IV rack.

12. A hospital bed as in claim 5 further comprising,
means for swinging said power column to positions at either corner of said bed, and
means for positioning said IV rack at the opposite corner of said bed, whereby a nurse can administer to a patient with equal facility while standing on either side of said bed.

13. A combination as in claim 1 further comprising,
longitudinal mattress sections at both sides of the head end of the bed, said sections being collapsible to narrow the bed by at least about 6 inches on a side, whereby a nurse standing on one side of a bed can easily reach a power column swung to the other side of said bed.

14. In a hospital room having a floor and ceiling, a generally rectangular bed, a power column having upper and lower ends, arms pivotally mounted at their first ends to the floor and ceiling, respectively, on an axis passing through the head end of said bed and connected at their second ends to said lower and upper ends of respectively of said power column, to permit said power column to pivot through an arc of about 180°, the corners of said bed at said head end being removed at permit said power column to swing on as small a radius as possible free from obstruction with bed corners.

* * * * *